United States Patent [19]

Miller

[11] Patent Number: 4,900,037

[45] Date of Patent: Feb. 13, 1990

[54] ACCELERATING ARROW

[76] Inventor: Gordon R. Miller, 1016 Oleadner, Lake Jackson, Tex. 77566

[21] Appl. No.: 860,855

[22] Filed: May 8, 1986

[51] Int. Cl.[4] ..... F41B 5/02

[52] U.S. Cl. ..... 273/416

[58] Field of Search ..... 273/416, 419, 420, 428

[56] References Cited

U.S. PATENT DOCUMENTS

| | | | |
|---|---|---|---|
| 1,455,075 | 5/1923 | Chapman | 273/416 X |
| 2,478,224 | 8/1949 | Armstrong | 273/428 |
| 4,050,696 | 9/1977 | Troncoso, Jr. | 273/420 |

*Primary Examiner*—Paul E. Shapiro

*Attorney, Agent, or Firm*—Gunn, Lee & Miller

[57] ABSTRACT

An improved arrow is set forth. In the preferred and illustrated embodiment, the arrow nock is formed at the back end of a telescoping hollow tubular portion. It is received within a cooperative telescoping tubular portion which comprises the shaft of the arrow. A compressible coil spring is placed in the two telescoping portions. On release of the arrow from a bow string, the coil spring is compressed. Before release is completed, the spring absorbs recoil and the arrow is restored to full length. This speeds up the arrow and reduces drop during trajectory.

6 Claims, 1 Drawing Sheet

ACCELERATING ARROW

BACKGROUND OF THE DISCLOSURE

This disclosure is directed to archery and more particularly to a unobvious arrow construction. The significance of this construction is best understood in describing the instantaneous loading that occurs in launching an arrow. Consider the traditional bow, and assume that it is a bow requiring about 50 pounds of pull. The bow string is placed in the arrow nock. On release, there is an instant at which 50 pounds of loading is applied to the arrow. At the time of release, the arrow is stationary. It is instantly struck from the arrow nock with the full force of the bow string. While the inertia of the arrow is being overcome, it is forced to move forward. An arrow is inherently a rigid body and does not have the ability to absorb the impact. That is, it is lacking the ability to compress and absorb energy in the fashion of a baseball or golf ball. Promptly after release of the arrow, the load on the arrow begins to drop rapidly. Thus, the force which is applied to the arrow is relatively unevenly distributed. The peak of the force is applied at the instant of release. As the bow string pushes the arrow forward in the first small portion of movement, the force drops off rapidly so that the best description of force applied to an arrow from a conventional bow is more of an impulse.

The compound bow has become popular lately. For a compound bow with a nominal 50 pound rating, the 50 pound peak occurs after some measure of arrow movement. The initial loading is reduced, perhaps about 70% of the peak loading. During arrow movement from the cocked position as the arrow is launched and as the compound bow operates in its peculiar fashion to supply power in its different loading, there is some benefit in redistributing the energy impulse delivered to the arrow by the compound bow. However, this still does not overcome the problem which exists in the fact that an arrow is something of a rigid device at the time of launch and is shocked with an impulse.

When launch occurs, the arrow is loaded in the fashion of a column. There is a tendency of the arrow to bend or flex along its length without regard to arrow stiffness. As stronger bows are used, the bending or flexing simply increases. It is submitted that this type of bending resulting from impulse loading from a conventional bow or a compound bow is a cause of inaccuracy. That is, the bending or flexing of the arrow at the time of launch causes the arrow to deflect off course.

It is desirable to make the arrow something of a resilient body. While conventional arrows are perhaps thousands of years old, recent arrow designs have included U.S. Pat. No. 3,759,519. This disclosure sets out a telescoping arrow including an internal spring. Primarily, this structure enables the arrow to collapse for storage or transportation. Perhaps a similar device is a weight moved by internal upset action in a toy missile described in U.S. Pat. No. 3,181,269. A less pertinent is U.S. Pat. No. 3,021,139. Perhaps equally U.S. Pat. No. 3,586,332 is just as remote. A dart having an internal spring to enable tip breakaway is set forth in U.S. Pat. No. 4,109,915. It is submitted that the present structure represents a patentable advance over the structures shown in these references.

SUMMARY OF THE PRESENT DISCLOSURE

Briefly, this disclosure is directed to an arrow which operates as a resilient body. It is able to accelerate more rapidly. It is constructed with an internal spring just in front of the nock, the spring compressing and enabling energy to be stored in the spring momentarily. This delivers energy for accelerating the arrow during release so that the release and launch of the arrow is more smoothly loaded. The energy that is stored in the spring accelerates the arrow to obtain higher velocity, much as a resilient ball (such as a baseball or golf ball) accelerates faster than the club speed after impact and compression.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
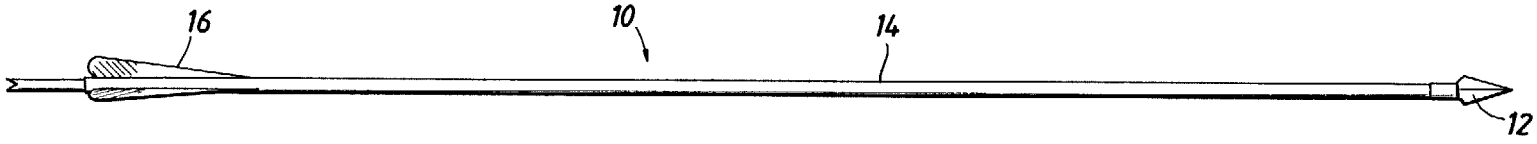
FIG. 1 is a side view of an arrow constructed in accordance with the teachings of this disclosure.
Figure 2:
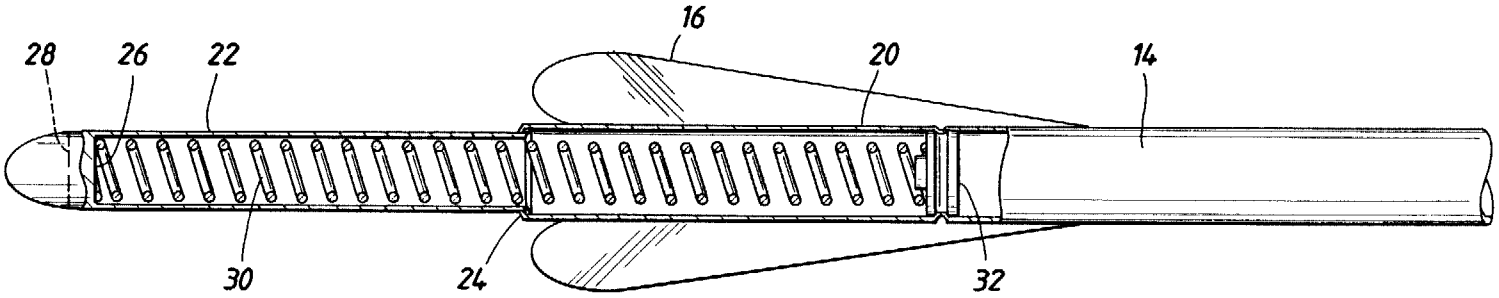
FIG. 2 is an enlarged sectional view of the rear portion of the arrow shown in FIG. 1 showing an internally located coil spring in its extended state.

Attention is now directed to FIG. 1 of the drawings where the numeral 10 identifies an arrow constructed in accordance with the teachings of this disclosure. The arrow has a conventional tip 12 is attached to a shaft 14. The shaft is of conventional weight and length. It is made of well known materials and has stiffness common to arrows. The arrow shaft 14 supports a set of feathers or vanes 16 incorporated to guide the arrow in flight. The center of gravity, weight and stiffness of the arrow 10 is identical to that of a conventional arrow, although the arrow can be made lighter in weight since there will be less end-to-end differential force on the arrow at any given time. It is, by all appearances, conventional in all details other than the telescoping at the rear of the arrow as will be described with FIG. 2.

This enlarged sectional view shows the shaft to be constructed with an outside sleeve 20. It is larger than a sleeve 22. The sleeve 22 is able to telescope on the interior of the sleeve 20. They are sized so that telescoping movement is permitted. The two sleeves are constructed with facing peripheral lips which are upturned to form an interlocking connection. That is, the sleeve 20 includes a lip 24 which is crimped inwardly to lock around a facing peripheral lip on the sleeve 22. This permits the sleeve 22 to extend to the maximum length shown in FIG. 2. The sleeve 22 is closed over at 26 at the remote end. This defines the solid shaft portion which is then shaped or cut with the arrow nock 28. This portion of the arrow is of conventional size, shape and construction and provides the archer with an arrow that otherwise feels and seems to be normal. This normal construction and feel around the nock is important to enable the archer to use this arrow without modification of shooting style. Different "weight" arrows enable the archery to select his preferred weight just as golfers select different compression balls i.e., 80, 90, 100.

The numeral 30 identifies a coil spring which is placed in the arrow. The coil spring is relatively stiff. It is preferably approximately as stiff as the draw power of the bow. That is, if the bow is nominal 50 pound bow, the spring constant should be optimized to obtain loading of the spring. In other words, the compressive force required to load the spring ideally should be about the draw force of the bow to enable spring compression. The spring 30 extends to a transverse wall 32 in the arrow shaft. This limits the location of the spring. The spring is compressed against the backwall 26 previously described. The number of turns in the spring is subject to variation over a wide range dependent on the gauge of wire used to wind the spring, total spring length and other scale factors. In like fashion, the length of the telescoping portion 22 can be varied, again as a scale factor. Accordingly, a typical range of compression for the spring shown in FIG. 2 may range from a fraction of an inch to something more than this. In part, this may depend on the length of the bow and the length of the arrow. Because changes in arrow loading which arise from arrow launch occur so rapidly, there is really little time for compression of the spring 30.

Figure 3:
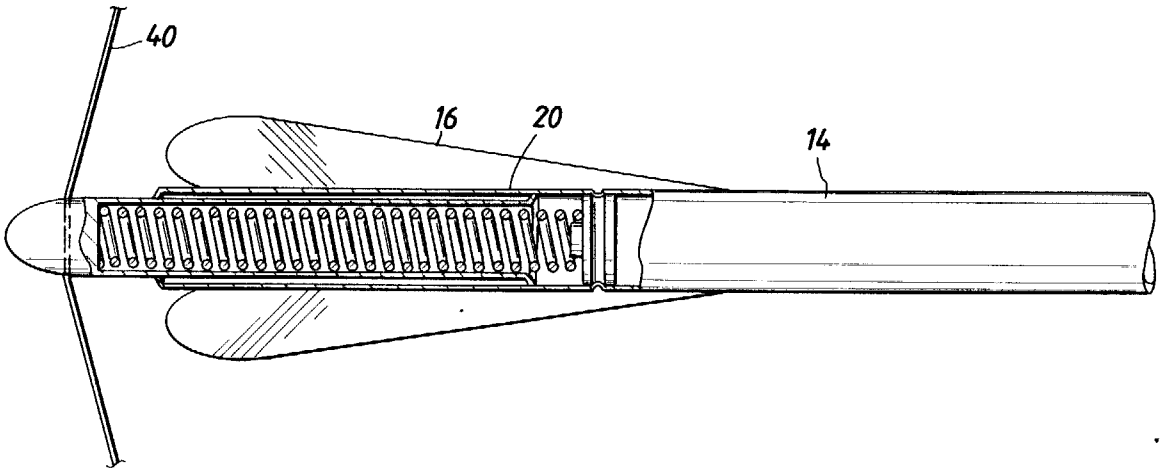
FIG. 3 is a view similar to FIG. 2 showing the arrow of FIG. 2 just at the instant of launch at which time the coil spring is substantially compressed.

Attention is now directed to the arrow in this compressed state as shown in FIG. 3. There, the bow string is identified by the numeral 40 and is in the arrow nock. Recall that the archer normally grasps the string and the very back tip of the arrow before release. If a mechanical release device is used, it grips the string adjacent to the nock at 22. The archer's grip is thus placed on the arrow at the rearward portion 22. At this juncture, the coil spring 30 is extended to full length. At the very instant of release with either a convention bow or compound bow, the string 40 delivers an impulse load to the arrow. The arrow drives forward, but the arrow does not move because it is held momentarily stationary by its own inertia. When this occurs, the arrow would ordinarily flex or bend in the fashion of an end loaded column. However, this loading on the arrow 10 causes the spring 30 to compress. While the spring 30 is being compressed, the moving string continues its forward stroke. Thus, both compression of the spring and the beginning movement of the arrow occur simultaneously. As the spring is compressed more and more, the compression creates a type of recoil in the arrow. When the arrow finally breaks free of the bow spring at which time the bow string snaps back to its unloaded position, recoil has been stored in the spring. This recoil storage occurs during the first part of arrow release. The spring 30 is thus quickly compressed and quickly elongates back to its full length. The rapidity at which this occurs then depends in part on spring stiffness, weight of the arrow shaft and other scale factors. It also depends on the length of travel of the telescoping tubular member 22. It is desirable to scale these values such that the recoil which is absorbed in the spring 30 is released (by permitting the spring to return to its full length) while the arrow is still being forced forward near the end of travel of the bow string. If the bow string is in contact with the arrow for a travel of about 20 inches, it is desirable that the arrow return to its full length during the last third or quarter of travel of the arrow in contact with the bow string 40. At this juncture, the inertia of the arrow has been overcome more smoothly. The arrow shaft does not seem to shutter, bend or flex as occurs with instantaneous column loading. Moreover, the arrow is accelerated to a higher velocity. That is, the force applied behind the arrow is sustained at a high value for a longer portion of string stroke. Sustaining this force (from the string and also from the spring recoil) for a longer portion of the stroke smoothes the launch of the arrow and accelerates the arrow to a higher release velocity. This yields a flatter projectory of the arrow after the launch.

The accelerating arrow 10 of this disclosure after release functions in the same fashion as a conventional arrow. Thus, they can be used for archery target practice. It can also be equipped with a hunting tip to thereby enable use of the arrow in game hunting.

In summary, it is one purpose of this disclosure to describe an arrow which can be used with both conventional and compound bows. It functions in the conventional fashion and is used by the archer without modification of techniques and skills of the archer. Moreover, it provides a different or improved feel on release. There seems to be less jarring blow when the arrow is released more smoothly and the arrow seems to leave the bow with less of a jolt.

While the foregoing is directed to the preferred embodiment, the scope of the present disclosure is determined by the claims which follow.

What is claimed is:

1. An elongate arrow having a tip, an elongate shaft behind the tip, and comprising a rearward arrow nock for engaging the string of a bow, internal resilient means within the arrow shaft compressed momentarily on launch of the arrow after engaging the arrow with a bow string in the nock, wherein said resilient means is a compressed coil spring having two opposite ends, and one end is received at a transverse wall and said arrow nock is formed immediately adjacent to said transverse wall, and wherein said resilient means in said shaft momentarily receives and stores energy from the bow string release.

2. The apparatus of claim 1 wherein said arrow shaft has first and second elongate tubular portions telescoped together, and said resilient means is received therein and enclosed within said first and second telescoping portions.

3. The apparatus of claim 2 wherein said resilient means forces said first and second telescoping portions to extend full length when not compressed and said first and second telescoping portions are permitted to telescope on launch from a bow string.

4. The apparatus of claim 3 wherein said telescoping portions interlock by engaging peripheral lips.

5. The apparatus of claim 1 wherein said arrow nock is formed on said transverse wall.

6. The apparatus of claim 5 wherein said arrow nock is transverse across said arrow shaft and internally of said shaft, and said shaft and transverse wall form a closed end tubular portion enclosing said resilient means in contact with said transverse wall.

* * * * *